US012601090B2

(12) United States Patent
Chin

(10) Patent No.: US 12,601,090 B2
(45) Date of Patent: Apr. 14, 2026

(54) CLOSED LOOP RECYCLING IDENTIFICATION SYSTEM

(71) Applicant: Guey N Chin, Florham Park, NJ (US)

(72) Inventor: Guey N Chin, Florham Park, NJ (US)

( * ) Notice: Subject to any disclaimer, the term of this patent is extended or adjusted under 35 U.S.C. 154(b) by 515 days.

(21) Appl. No.: 18/221,965

(22) Filed: Jul. 14, 2023

(65) Prior Publication Data

US 2025/0019866 A1 Jan. 16, 2025

(51) Int. Cl.

| | |
|---|---|
| ***D01F 1/02*** | (2006.01) |
| ***D01D 1/02*** | (2006.01) |
| ***D01F 6/62*** | (2006.01) |
| ***D03D 15/283*** | (2021.01) |
| ***D03D 15/50*** | (2021.01) |

(52) U.S. Cl.

CPC ..... *D01F 1/02* (2013.01); *D01D 1/02* (2013.01); *D01F 6/62* (2013.01); *D03D 15/283* (2021.01); *D03D 15/50* (2021.01); *D10B 2331/04* (2013.01)

(58) Field of Classification Search

CPC ..... D01F 1/02; D01F 6/62; D03D 15/283; D03D 15/50; D10B 2331/04; D01D 1/02

USPC ..... 8/115.7

See application file for complete search history.

(56) References Cited

FOREIGN PATENT DOCUMENTS

KR 102505931 B1 * 3/2023 ..... D06M 15/507

* cited by examiner

*Primary Examiner* — Camie S Thompson

(74) *Attorney, Agent, or Firm* — Demian K. Jackson; Jackson IPG PLLC

(57) ABSTRACT

A closed loop recycling identification system includes a first flow including steps of collecting polyester materials by recycling waste materials from a source to collect polyester materials, spinning the collected polyester fibers as yarn with a tracer being added thereto, weaving the yarn into fabric, and manufacturing the fabric into textile products; a second flow including steps of cleaning the collected waste materials having the tracer, classifying the clean waste materials, and pulverizing the classified waste materials into polyester fibers or pellets; and a joining flow joining the spinning step to finish a closed cycle. It is possible to confirm the textile products as ones made of recyclables by identifying the tracer.

14 Claims, 3 Drawing Sheets

CLOSED LOOP RECYCLING IDENTIFICATION SYSTEM

BACKGROUND OF THE INVENTION

1. Field of the Invention

The invention relates to recycling and more particularly to a closed loop recycling identification system for adding a tracer to a recyclable in a yarn spinning step so that it is possible to confirm a textile product as one made of the recyclable by identifying the tracer, and traceability system for entire process.

2. Description of Related Art

At present, most of used PET (polyethylene terephthalate) bottles, used clothes, waste textiles and other related products in the world, except some being recycled, are incinerated or land filled as waste. Carbon dioxide produced by the incineration has caused the earth's greenhouse effect and produces harmful substances that are harmful to health. Further, landfilling may discharge harmful substances to underground water and produce odor, thereby causing serious pollution problems to living and the environment. In recent years, many governments and private sectors have implemented recycling of used PET bottles. For example, in a known "recycling method and system thereof" discloses a method for converting used products to intermediate raw materials which can be used to manufacture products again, and a system for recycling using the method. The recycling consumes a small amount of energy. However, the patent is directed to a group, and each of joining upstream and downstream members do not have a control mechanism to control the quantity of each link except that the joining upstream and downstream members know each other. While the patent uses identifications to manage the recycling of products, the identification is not embedded in the product. There is no way to confirm whether a product is made of recyclables or not. Further, transaction price and bonus are disclosed by the patent and it is prone to transaction disputes. Thus, the need for improvement still exists.

In view of the above, the present inventor has worked deeply on the issues and aggressively searched for a solution based on years' experience in the related field, and through endeavor of repeated study and trial, eventually successfully develops a closed loop recycling identification system in order to overcome the drawbacks of the conventional art.

SUMMARY OF THE INVENTION

It is therefore a first object of the invention to provide a closed loop recycling identification system for adding a tracer to a recyclable in a yarn spinning step so that it is possible to confirm textile products as ones made of the recyclable by identifying the tracer. For a waste recycling plant, it can accept any used items or used clothes if the tracer is embedded therein or reject same if the tracer is not embedded therein. By taking advantage of the closed loop recycling identification system, it is possible to recycle any recyclables having the tracer coupled with a block chain platform traceability software system.

A second object of the invention is to provide a closed loop recycling identification system having advantages of reducing waste, decreasing carbon emission, decreasing energy consumption, decreasing pollution, and reducing manufacturing cost.

To achieve above and other objects of the invention, the invention provides a closed loop recycling identification system, comprising a first flow; a second flow; and a joining flow; wherein the first flow comprises a first step of collecting polyester materials by recycling waste materials from a source to collect polyester materials; a second step of spinning the collected polyester fibers as yarn with a tracer being added thereto so that the yarn has the tracer; a third step of weaving the yarn into fabric by weaving the yarn having the tracer into fabric; and a fourth step of manufacturing the fabric into textile products by manufacturing the fabric having the tracer into textile products; wherein the second flow comprises step I of cleaning by cleaning the collected waste materials having the tracer; step II of classification by classifying the clean waste materials having the tracer as materials having no more than 100% of polyester fibers and other materials or materials having 100% of polyester fibers; and step III of pulverizing the classified waste materials into polyester fibers if the clean waste materials having the tracer are classified as materials having no more than 100% of polyester fibers and other materials; or step IV of pulverizing the classified waste materials into polyester pellets if the clean waste materials having the tracers are classified as materials having 100% of polyester fibers; wherein the joining flow joins the second step to finish a closed cycle; and wherein it is possible to confirm the textile products as products made of recyclables by identifying the tracer.

Preferably, the source of waste materials of the first step includes PET bottles, used clothes and decorations, used industrial and household items made of polyester fibers, used textile products, and textile waste.

Preferably, the polyester materials of the first step are polyester materials collected from PET bottles, used clothes and decorations, used industrial and household items made of polyester fibers, used textile products, and textile waste.

Preferably, the PET bottles are pulverized and converted to polyester fibrous pellets which are spun into long-spun yarn.

Preferably, the second step involves spinning the polyester fibers into long-spun yarn.

Preferably, the second step involves spinning the polyester fibers into long-spun yarn which is cut into short-spun yarn as required.

Preferably, the source of waste materials of the first step includes used clothes and decorations, used industrial and household items made of polyester fibers, used textile products made of polyester, and textile waste; and wherein the collected polyester materials are spun into short-spun yarn.

Preferably, the added tracer of the second step has 1 wt % or less of the collected polyester fibers.

Preferably, wherein the tracer is fibrous materials of the yarn or fibers of different shapes of the yarn.

Preferably, the tracer is fibers of different colors of the yarn.

Preferably, the first flow further comprises a fifth step of selling the textile products having the tracer to retailers.

Preferably, the first flow further comprises a sixth step of selling the textile products having the tracer to consumers.

Preferably, further comprises a plurality of certified waste recycling plants, a plurality of certified spinning mills, a plurality of certified weaving factories, a plurality of certified textile manufacturers, and a plurality of certified sales ends which are formed as a block chain network.

Preferably, the closed loop recycling identification system is applied to the block chain network as a closed loop recycling identification system.

The above and other objects, features and advantages of the invention will become apparent from the following detailed description taken with the accompanying drawings.

DETAILED DESCRIPTION OF THE INVENTION

Figure 1:
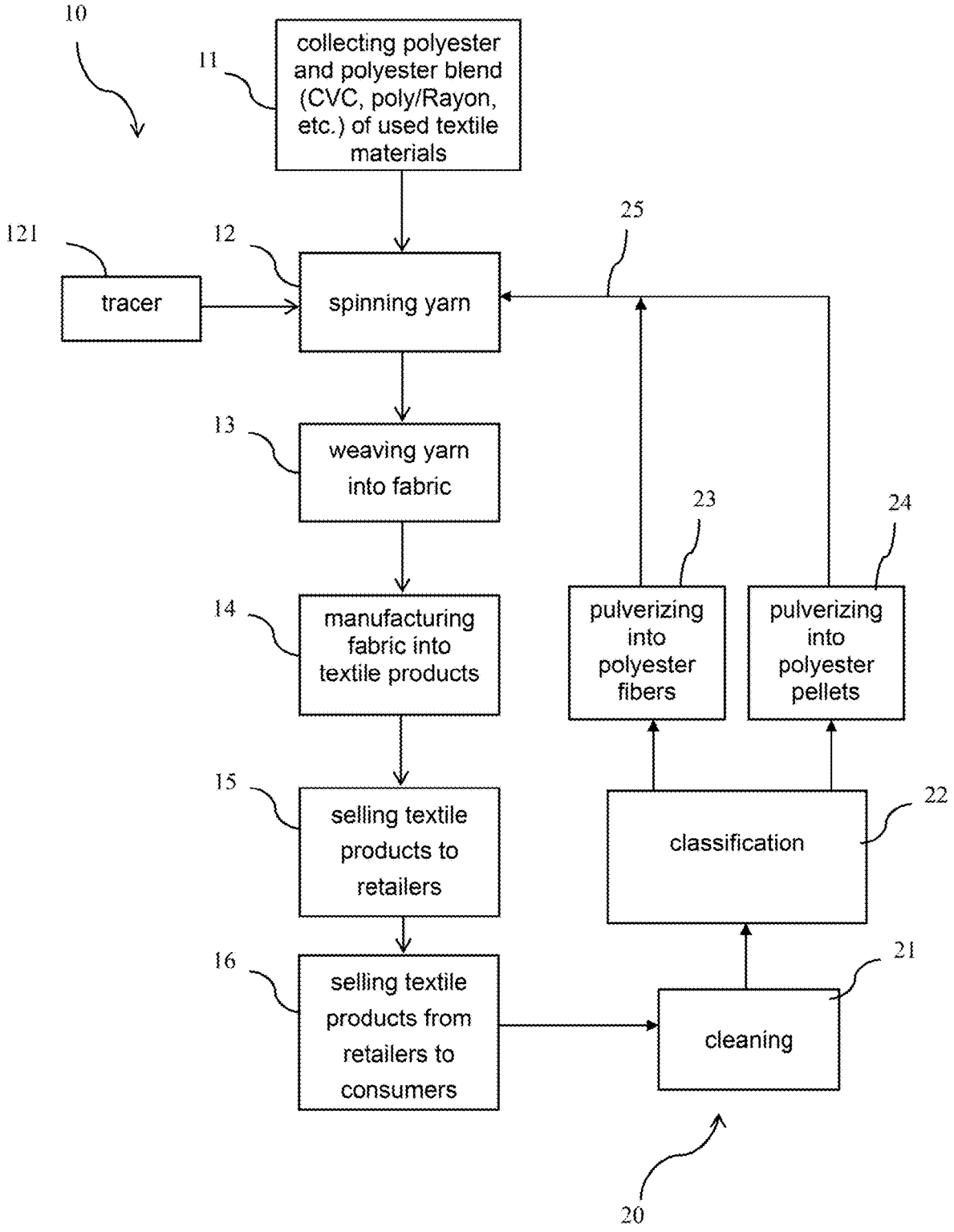
FIG. 1 is a flow chart of a closed loop recycling identification system according to the invention.
Figure 2:
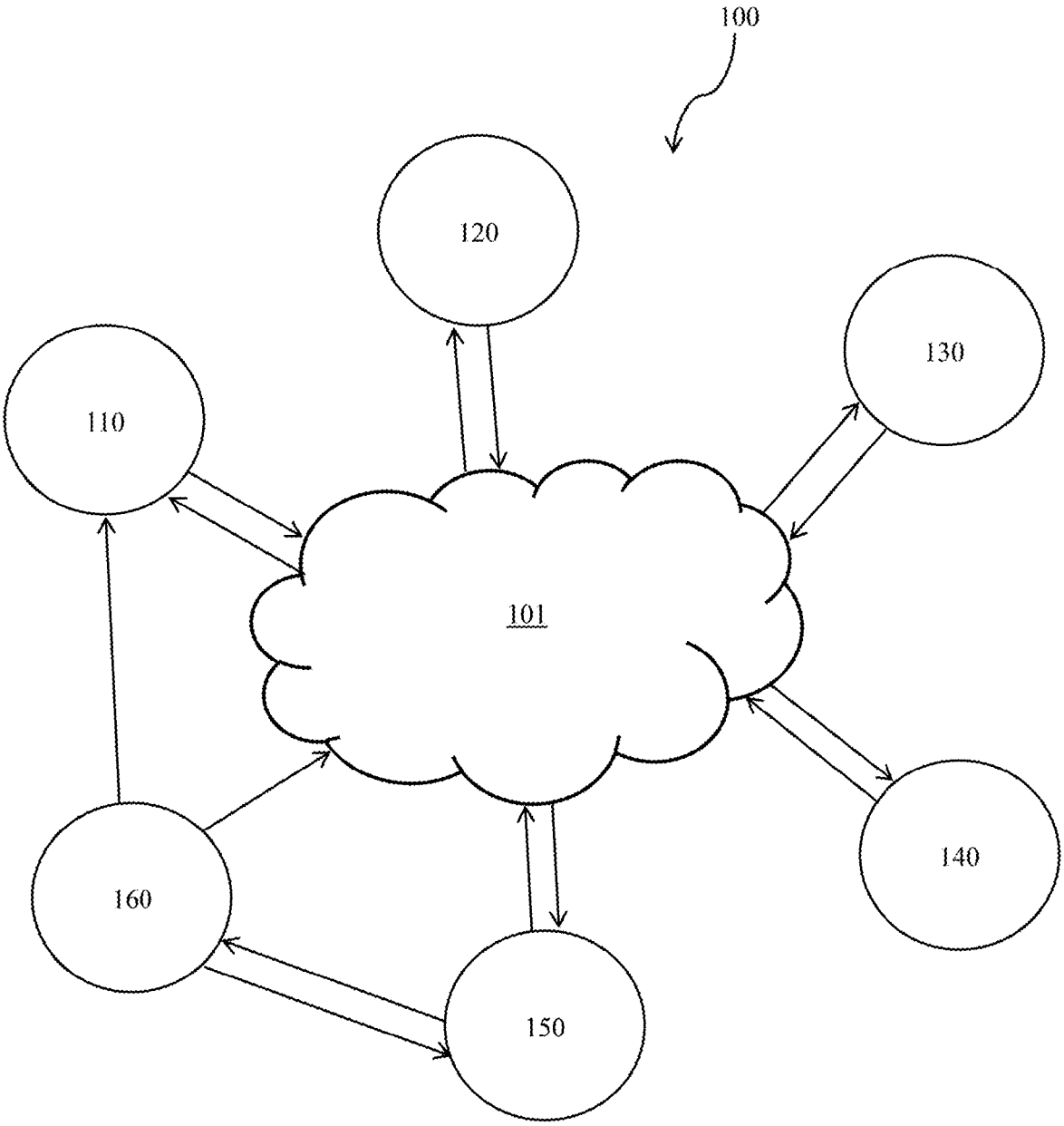
FIG. 2 schematically depicts the closed loop recycling identification system of the invention.
Figure 3:
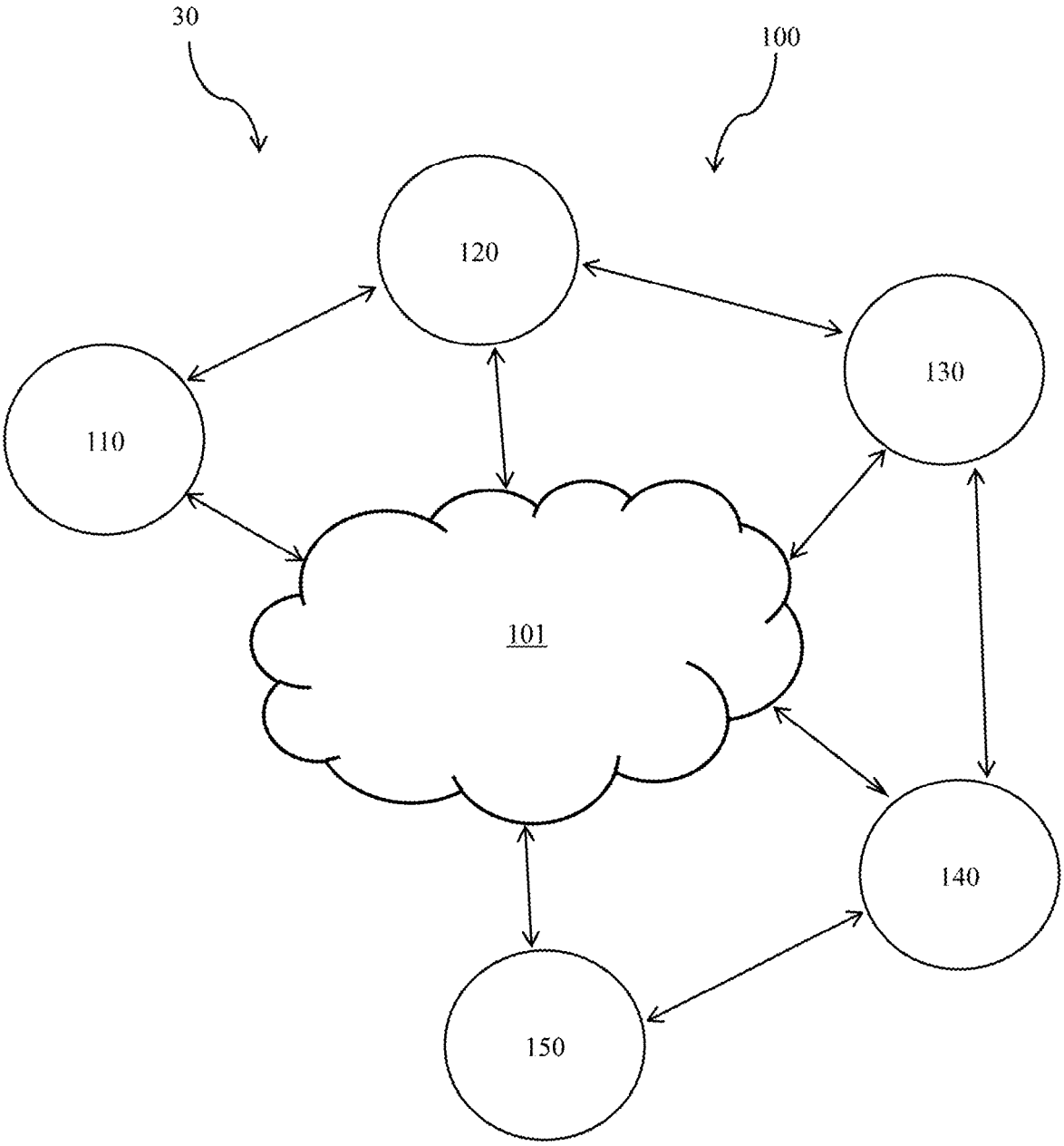
FIG. 3 schematically depicts an order flow being added to the closed loop recycling identification system of the invention.

Referring to FIGS. 1 to 3 in which FIG. 1 illustrates a closed loop recycling identification system in accordance with the invention. The system comprises a first flow 10 and a second flow 20 as discussed in detail below.

The first flow 10 is applied to sources of waste materials to be recycled which do not includes a tracer. The first flow 10 comprises a step 11 of collecting polyester materials in which a waste recycling plant 110 recycles waste materials from the sources of waste materials to collect the polyester materials. The source of waste materials includes PET bottles which are pulverized by shredding, the pulverized plastics are further converted to polyester fibrous pellets; recycled used clothes and decorations which are cleaned and pulverized by shredding, and the pulverized clothes and decorations are processed to collect polyester fibers; used industrial and household items which are cleaned and pulverized by shredding, and the pulverized items are processed to collect polyester fibers; and used textiles or textile wastes which are pulverized by shredding and the pulverized textiles or wastes are processed to collect polyester fibers. The collected polyester fibers are converted to polyester pellets.

The first flow 10 further comprises a step 12 of spinning the collected polyester fibers as yarn. Through a spinning mill 120, the polyester fiber pellets are spun into long-spun yarn, or the long-spun yarn is cut into short-spun yarn as required. The spinning mill 120 can also spin recycled polyester fibers into short-spun yarn. A tracer 121 is added to the collected polyester fibers of the step 12. In detail, the tracer 121 of 1 wt % or less of the collected polyester fibers is added to the step 12 of spinning the collected polyester fibers so that the formed yarn can be identified whether they are products of the invention. The tracer 121 is fibrous materials of the yarn, fibers of different shapes of the yarn, or fibers of different colors of the yarn. Alternatively, silver ions or minerals are added to the yarn as the tracer 121. Still alternatively, fibers of different sectional shapes such as circle, triangle, W, M, 4-T, U, X, Y, Z, cross, double-cross, cup, snowman, pentagon, hollow cylinder, hollow cross, hollow Y or any of the above combinations thereof are added to the yarn as the tracer 121. Still alternatively, fibers having a color of red having green dyes is added to the yarn as the tracer 121. The short-spun yarns of different sources are 100% recycled polyester fibers and are used to manufacture textiles.

The first flow 10 further comprises a step 13 of weaving the yarn into fabric. In detail, a weaving factory 130 weaves the yarn having a tracer 121 into fabric.

The first flow 10 further comprises a step 14 of manufacturing the fabric into textile products. In detail, a textile manufacturer 140 manufactures the fabric having the tracer 121 into textile products.

The first flow 10 further comprises a step 15 of selling the textile products to exporters, dealers, or retailers.

The first flow 10 further comprises a step 16 of selling the textile products from the exporters, the dealers, or the retailers to general consumers.

The textile products made from the first flow 10 can be identified as ones made by the invention since it has the tracer 121.

The second flow 20 is related to the processing of waste materials having the tracer 121 and comprises a step 21 of cleaning. In detail, the waste recycling plant 110 cleans the collected waste materials having the tracer 121 and removes materials not having 100% polyester such as buckles, zippers, or the like from the clean waste materials. Additionally, sub-steps of killing microorganisms and bag packaging are included in the step 21.

The second flow 20 further comprises a step 22 of classifying the clean waste materials having the tracer 121 as ones having no more than 100% of polyester fibers and other materials or ones having 100% of polyester fibers. The second flow 20 further comprises a step 23 of pulverizing the classified waste materials into polyester fibers if the clean waste materials are classified as materials having no more than 100% of polyester fibers and other materials. Alternatively, the second flow 20 further comprises a step 24 of pulverizing the classified waste materials into polyester pellets if the clean waste materials are classified as 100% of polyester fibers. Additionally, color is added as an item of the classification.

The second flow 20 further comprises a step 25, as a subsequent step of step 23 or 24, of adding a new tracer 121 to a product of step 23 and spinning the product into long-spun yarn, or adding a new tracer 121 to a product of step 24 and spinning the product into short-spun yarn. The step 25 returns to the step 12 (i.e., the step 25 being a joining step). This completes a closed cycle which can be repeated.

Fabric and textile products made by the invention have a tracer which can be identified visually by microscope. Thus, a third party can identify a source of the waste materials which are used to manufacture the fabric and textile products of the invention by recycling. The products of the invention are manufactured from recycled waste materials in a closed cycle. As a result, waste is reduced, carbon emission is decreased, energy consumption is decreased, pollution is decreased, and manufacturing cost is decreased.

Referring to FIG. 2 specifically, it schematically depicts the closed loop recycling identification system 100 of the invention. The invention is applicable to the closed loop recycling identification system 100 for controlling a block chain network. The closed loop recycling identification system 100 comprises a plurality of waste recycling plants 110, a plurality of spinning mills 120, a plurality of weaving factories 130, a plurality of textile manufacturers 140, a plurality of sales ends 150, a plurality of consumer ends 160, and a cloud database 101. All components except the consumer ends 160 can upload data records to the cloud database 101 respectively. The waste recycling plants 110, the spinning mills 120, the weaving factories 130, the textile manufacturers 140, and the sales ends 150 are certified by the closed loop recycling identification system 100 so that they can access the closed loop recycling identification system 100. The closed loop recycling identification system 100 may issue an identification to each of the waste recycling plants 110, the spinning mills 120, the weaving factories 130, the textile manufacturers 140, and the sales ends 150 after the certification has been finished. The consumer ends 160 may confirm any bought products are made by the recycling process of the invention by viewing the identification. Similarly, the consumer ends 160 may send waste materials having the tracer 121 to the waste recycling plant 110 (or to the waste recycling plant 110 via the closed loop recycling identification system 100) for recycling. The closed loop recycling identification system 100 records each waste source, each tracer, each production record, each order record, and each delivery record.

Referring to FIG. 3 specifically, it schematically depicts an order flow 30 being added to the closed loop recycling identification system 100 of the invention. The invention further comprises the order flow comprising the steps of when the sales end 150 wants to sell a textile product (e.g., clothes) made from the recycled waste 20 of the invention, the sales end 150 may order the textile product from a textile manufacturer 100 which is recommended by a certified unit of the closed loop recycling identification system 100. Further, the textile manufacturer 100 may order a specified amount of fabric based on the textile product from a weaving factory 130 which is recommended by a certified unit of the closed loop recycling 25 identification system 100. Furthermore, the weaving factory 130 may order a specified amount of yarn based on the specified amount of fabric from a spinning mill 120 which is recommended by a certified unit of the closed loop recycling identification system 100. In addition, the spinning mill 120 may order a specified amount of polyester pellets or recycled polyester fibers based on the specified amount of yarn from a waste recycling plant 110 which is recommended by a certified unit of the closed loop recycling identification system 100. The specified amount of polyester pellets or recycled polyester fibers are used for manufacturing yarn. This is a closed loop recycling identification system.

The invention has the following advantages and benefits in comparison with the conventional art: the closed loop recycling identification system 100 sets conditions for adding the tracer 121 in the cloud database 101 so that the waste recycling plant 110 may identify waste materials sent from the consumer ends 160 are made by the closed loop recycling identification system 100 of the invention by means of the identification. Further, it may monitor each producer (or consumer) of the manufacturing process based on batches or records. The sales ends 150 may identify a source of waste materials by means of an identification issued by the closed loop recycling identification system 100. Thus, manufacturing date and number of products of each production step can be controlled. As a result, a product having verified compositions is provided. The consumer ends 160 may generate a QR code by means of the closed loop recycling identification system 100 so that a consumer may be aware that whether a product is produced by recycled materials by scanning the QR code.

Conditions of the tracer 121 can set as one of any materials, fibers of different shapes, or fibers of different colors of the yarn. Alternatively, silver ions or minerals are added to the yarn as the tracer 121. Still alternatively, fibers of different sectional shapes such as circle, triangle, W, M, 4T, U, X, Y, Z, cross, double-cross, cup, snowman, pentagon, hollow cylinder, hollow cross, hollow Y or any of the above combinations thereof are added to the yarn as the tracer 121. Still alternatively, fibers having a color of red having green dyes is added to the yarn as the tracer 121. The waste recycling plant 110 may identify a source of waste materials by means of the closed loop recycling identification system 100. The source of waste materials means a source of waste materials without any tracer. After a unit certified by the closed loop recycling identification system 100 has identified the source of waste materials, the tracer 121 can be added to the closed loop recycling identification system 100. As a result, the production capacity is greatly increased and more waste materials are recycled for further use.

While the invention has been described in terms of preferred embodiments, those skilled in the art will recognize that the invention can be practiced with modifications within the spirit and scope of the appended claims.

What is claimed is:

1. A closed loop recycling identification system, comprising:

a first flow;

a second flow; and a joining flow;

wherein the first flow comprises:

a first step of collecting polyester materials by recycling waste materials from a source to collect polyester materials;

a second step of spinning the collected polyester fibers as yarn with a tracer being added thereto so that the yarn has the tracer;

a third step of weaving the yarn into fabric by weaving the yarn having the tracer into fabric; and a fourth step of manufacturing the fabric into textile products by manufacturing the fabric having the tracer into textile products;

wherein the second flow comprises:

step I of cleaning by cleaning the collected waste materials having the tracer;

step II of classification by classifying the clean waste materials having the tracer as materials having no more than 100% of polyester fibers and other materials or materials having 100% of polyester fibers; and step III of pulverizing the classified waste materials into polyester fibers if the clean waste materials having the tracer are classified as materials having no more than 100% of polyester fibers and other materials; or step IV of pulverizing the classified waste materials into polyester pellets if the clean waste materials having the tracers are classified as materials having 100% of polyester fibers;

wherein the joining flow joins the second step to finish a closed cycle; and wherein it is possible to confirm the textile products as products made of recyclables by identifying the tracer.

2. The closed loop recycling identification system of claim 1, wherein the source of waste materials of the first step includes PET bottles, used clothes and decorations, used industrial and household items made of polyester fibers, used textile products, and textile waste.

3. The closed loop recycling identification system of claim 1, wherein the polyester materials of the first step are polyester materials collected from PET bottles, used clothes and decorations, used industrial and household items made of polyester fibers, used textile products, and textile waste.

4. The closed loop recycling identification system of claim 3, wherein the PET bottles are pulverized and converted to polyester fibrous pellets which are spun into long-spun yarn.

5. The closed loop recycling identification system of claim 1, wherein the second step involves spinning the polyester fibers into long-spun yarn.

6. The closed loop recycling identification system of claim 1, wherein the second step involves spinning the polyester fibers into long-spun yarn which is cut into short-spun yarn as required.

7. The closed loop recycling identification system of claim 1, wherein the source of waste materials of the first step includes used clothes and decorations, used industrial and household items made of polyester fibers, used textile products made of polyester, and textile waste; and wherein the collected polyester materials are spun into short-spun yarn.

8. The closed loop recycling identification system of claim 1, wherein the added tracer of the second step has 1 wt % or less of the collected polyester fibers.

9. The closed loop recycling identification system of claim 8, wherein the tracer is fibrous materials of the yarn or fibers of different shapes of the yarn.

10. The closed loop recycling identification system of claim 8, wherein the tracer is fibers of different colors of the yarn.

11. The closed loop recycling identification system of claim 1, wherein the first flow further comprises a fifth step of selling the textile products having the tracer to retailers.

12. The closed loop recycling identification system of claim 1, wherein the first flow further comprises a sixth step of selling the textile products having the tracer to consumers.

13. The closed loop recycling identification system of claim 1, further comprising a plurality of certified waste recycling plants, a plurality of certified spinning mills, a plurality of certified weaving factories, a plurality of certified textile manufacturers, and a plurality of certified sales ends which are formed as a block chain network.

14. The closed loop recycling identification system of claim 13, wherein the closed loop recycling identification system is applied to the block chain network as a closed loop recycling identification system.

* * * * *